US010696088B2

(12) United States Patent
Walters et al.

(10) Patent No.: US 10,696,088 B2
(45) Date of Patent: Jun. 30, 2020

(54) PEN PRESS AND METHODS

(71) Applicants: James D. Walters, Aurora, IL (US); Taylor James Hall, Palatine, IL (US)

(72) Inventors: James D. Walters, Aurora, IL (US); Taylor James Hall, Palatine, IL (US)

(73) Assignee: Nomis LLC, Palatine, IL (US)

( * ) Notice: Subject to any disclaimer, the term of this patent is extended or adjusted under 35 U.S.C. 154(b) by 87 days.

(21) Appl. No.: 15/948,794

(22) Filed: Apr. 9, 2018

(65) Prior Publication Data

US 2019/0308441 A1 Oct. 10, 2019

(51) Int. Cl.

| | |
|---|---|
| ***B43K 15/00*** | (2006.01) |
| ***B30B 9/28*** | (2006.01) |
| *B43K 25/02* | (2006.01) |

(52) U.S. Cl.

CPC ..... *B43K 15/00* (2013.01); *B30B 9/28* (2013.01); *B43K 25/02* (2013.01)

(58) Field of Classification Search

None

See application file for complete search history.

(56) References Cited

U.S. PATENT DOCUMENTS 8,387,222 B2 3/2013 Chen et al.
2011/0094077 A1* 4/2011 Siddall ..... B25B 27/02 29/281.1

OTHER PUBLICATIONS

U.S. Appl. No. 29/643,478, filed Apr. 9, 2018, Walters et al.
Deluxe Pen Press, WOODRIVER #154308W; 9 pages; known to applicant prior to Apr. 9, 2018; date last visited Jul. 6, 2018; https://www.woodcraft.com/products/woodriver-deluxe-pen-press.
Pen Assembly Press V5; Penn State Industries; 2 pages; known to applicant prior to Apr. 9, 2018; date last visited Jul. 6, 2018; https://www.pennstateind.com/store/PENPRESS5.html.
Spring Loaded Heavy-Duty Pen Asembly Press $V_4$ Item #: $PENPRESS_4$; 2 pages; known to applicant prior to Apr. 9, 2018; date last visited Jul. 6, 2018; https://www.timberturners.com/product-p/penpress4.htm.
Assembly/Disassembly Pen Press; 2 pages; date last visited Jul. 6, 2018; known to applicant prior to Apr. 9, 2018; https://www.pennstateind.com/store/PENPRESSXL.html.
Rockler Pen Press/Drilling Jig; Item #: 24577; 6 pages; known to applicant prior to Apr. 9, 2018; date last visited Jul. 6, 2018; http://www.rockler.com/pen-press-drilling-jig.
(Continued)

*Primary Examiner* — Brian D Keller
(74) *Attorney, Agent, or Firm* — Reinhart Boerner Van Deuren P.C.

(57) ABSTRACT

A pen assembling press includes a base, a press unit, a carriage, and a positioning arrangement. Actuation of a lever moves an engagement head relative to the base along an actuation axis. A second engagement head is coaxial with the first engagement head. The carriage is movably mounted to the base. The positioning arrangement includes a slot, a plurality of recesses and a pin. The slot extends through the first leg in a direction perpendicular to the actuation axis. The slot has a constant height section having a height. The pin has a shaft and a head. The head is receivable in the recesses. The shaft has a thickness being substantially equal to the height of the constant height section of the slot. The pin is movable relative to the carriage along a pin axis that is perpendicular to the actuation axis to selectively engage and disengage the recesses.

17 Claims, 3 Drawing Sheets

(56) References Cited

OTHER PUBLICATIONS

Pen Press by Peachtreet Wppdwprking PW7004; 7 pages; known to applicant prior to Apr. 9, 2018; date last visited Jul. 6, 2018; https://www.amazon.com/PEN-PRESS-PEACHTREE-WOOD-WORKING-PW7004/dp/B003VI2CTK.

Big Horn 14515 Pen Turning Press—Lathe Turning Tools—Amazon.com; 6 pages; known to applicant prior to Apr. 9, 2018; date last visited Jul. 6, 2018; https://www.amazon.com/Big-Horn-14515-Turning-Press/dp/B003NE5ADC.

* cited by examiner

PEN PRESS AND METHODS

FIELD OF THE INVENTION

This invention generally relates to pen assembling presses.

BACKGROUND OF THE INVENTION

Hobbyists such as woodworkers will often make their own pens. To do this, the hobbyist will buy a component that provides the ink portion of the pen. The hobbyist will then either form a decorative outer component or buy a decorative outer component in which the ink portion will be inserted. Typically, the components will have a press fit engagement that maintains the two components connected to one another. Pen assembling presses have been used to assist in pressing the two components together. The present invention provides improvements over the current state of the art relating to these pen assembling presses.

BRIEF SUMMARY OF THE INVENTION

Embodiments of the present invention provide a new and improved pen assembling press and methods of use.

In one embodiment, the pen assembling press includes a base, a press unit, a carriage, and a positioning arrangement. The base has spaced apart first and second legs and an intermediate section extending between and maintaining the spacing between the first and second legs. The first and second legs and intermediate section form a base channel therebetween. The press unit includes a first engagement head and a lever. The lever is connected to the engagement head such that actuation of the lever moves the engagement head relative to the base along an actuation axis. The carriage carries a second engagement head. The second engagement head is coaxial with the first engagement head along the actuation axis such that actuation of the lever moves the first engagement head toward or away from the second engagement head along the actuation axis. The carriage is movably mounted to the base. The carriage including spaced apart first and second carriage legs defining a carriage channel therebetween. The carriage straddles the base with the base positioned at least in part within the carriage channel with the first and second legs and intermediate section positioned, at least in part, between the first and second carriage legs. The positioning arrangement is between the carriage and the base to selectively fix the position of the carriage relative to the base along the actuation axis. The positioning arrangement includes a slot, a plurality of recesses and a pin. The slot extends through the first leg in a direction perpendicular to the actuation axis. The slot extends lengthwise parallel to the actuation axis. The slot has a constant height section having a height. The plurality of recesses are offset along the actuation axis from one another and are adjacent the constant height section. The pin has a shaft and a head. The pin is carried by the carriage. The head is sized to be received in the recesses. The shaft has a thickness being substantially equal to the height of the constant height section of the slot. The pin is movable relative to the carriage within the slot along a pin axis that is perpendicular to the actuation axis to selectively engage and disengage the recesses. When the head is removed from the recesses, the carriage is movable along the actuation axis relative to the base. When the head is inserted into one of the recesses, the carriage is fixed along the actuation axis relative to the base.

In one embodiment, the pin is biased towards having the head engaged with one of the recesses.

In one embodiment, the pin extends through the first carriage leg. The pin includes an actuation button engageable by a user. The actuation button extends laterally outward beyond the first carriage leg in a relaxed state along the pin axis.

In one embodiment, a low-friction material is positioned between the carriage and the intermediate section providing reduced friction between the carriage and intermediate section.

In one embodiment, the low-friction material is acetal polyoxymethylene resin.

In one embodiment, the intermediate section is free of any exposed openings extending therethrough into the base channel from a top side facing the carriage and the press unit.

In one embodiment, a first foot is attached to the first leg. The first leg extends between the first foot and the intermediate section. A second foot is attached to the second leg. The second leg extends between the second foot and the intermediate section. A non-slip material is attached to the first and second feet to inhibit slipping of the first and second feet when located on a working surface.

In one embodiment, the second engagement head is slidably carried on the carriage along the actuation axis.

In one embodiment, a biasing member operably acts on the engagement head to bias the second engagement head towards the first engagement head along the actuation axis.

In one embodiment, the plurality of recesses are immediately adjacent to and intersect with the slot. The plurality of recesses are positioned laterally offset from the constant height section along the pin axis such the shaft of the pin cannot move into the recesses along an axis being perpendicular to the pin axis and perpendicular to the actuation axis.

In one embodiment, the positioning arrangement includes a pair of pins that are substantially identical and oriented opposite one another. The pins are pressed toward one another to disengage the recesses and allow the carriage to move. The pins are released and biased away from one another to engage corresponding recesses to prevent the carriage from moving along the actuation axis.

In an embodiment, a method of assembling a pen formed from, at least, a first component that is axially inserted into a second component. The method includes providing a pen assembling press as outlined above. The method includes actuating the pin of the pen assembling press along the pin axis to disengage the head from the plurality of recesses. The method includes sliding the carriage along the actuation axis with the shaft of the pin sliding within the constant height section generally parallel to the actuation axis. The method includes releasing the pin to engage the head with one of the plurality of recesses to fix the position of the carriage along the actuation axis.

In one method, the method includes positioning the first and second components between the first and second engagement heads. The method also includes actuating the lever to drive the first engagement head toward the second engagement head to press the first component into the second component.

One method includes biasing the second engagement head along the actuation axis by a biasing member after positioning the first and second components between the first and second engagement heads.

In one method, the step of actuating the pin includes overcoming a biasing force acting on the pin that biases the pin towards having the head engaged with one of the recesses.

In one method, the pin extends through the first carriage leg. The pin includes an actuation button engageable by a user. The step of actuating the pin includes pressing the actuation button laterally inward.

In one method, the intermediate section is free of any exposed openings extending therethrough from a top side facing the carriage and press unit into the base channel.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
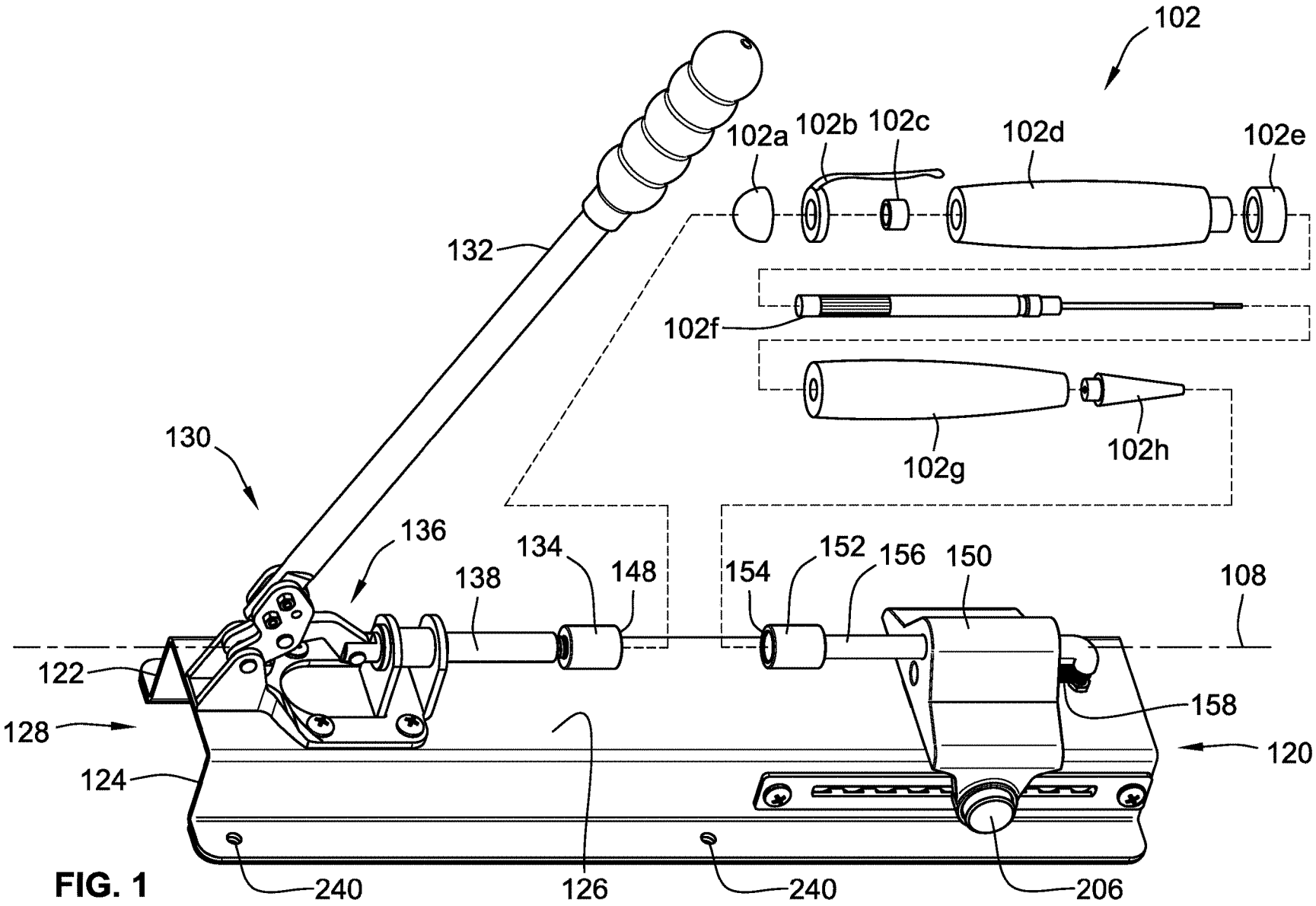
FIG. 1 is an isometric illustration of a pen assembling press according to an embodiment of the invention.

FIG. 1 illustrates a pen assembling press 100 (also referred to as "pen press 100"). The pen press 100 is used to assemble multiple components of a pen 102 (illustrated in exploded form in FIG. 1). For instance, an end cap 102A and end cap bushing 102C may be pressed into a upper body member 102D to secure a pocket clip 102C to the assembly. Additionally, the center ring 102E may be press fit onto upper body member 102D. Further, the pen assembling press 100 may be used to press the pen tip 102H into the lower body member 102G. An ink cartridge 102F is stored within the outer shell formed from the various other components, when fully assembled. The pen press 100 allows for applying axial pressure along an actuation axis 108 to the various components so as to press the press fit components together. It is noted that these are just examples of when the pen press 100 may be used while assembling a pen. Further, additional components may be press fit together. Additionally, all of the identified components are typically not simultaneously pressed together but pressed together in separate steps. While the pen press 100 is illustrated assembling a pen 102, the pen press 100 can be used to assemble components of other objects that need to be axially pressed together in a similar manner.

The pen press 100 includes a base 120 that includes first and second spaced apart legs 122, 124 that are connected to one another by an intermediate section 126 extending laterally therebetween. The intermediate section 126 being substantially perpendicular to the first and second legs 122, 124, e.g. preferably plus or minus ten degrees. The intermediate section 126 maintains the spacing between the first and second legs 122, 124. In the illustrated embodiment, the legs 122, 124 and intermediate section 126 are formed from a continuous piece of material, such as a stamped or bent from a single continuous piece of metal. The first and second legs 122, 124 and intermediate section 126 form a base channel 128.

A press unit 130 is attached to the base 120. In this embodiment, the press unit 130 is attached to a top or outer surface of the intermediate section 126, e.g. a side opposite base channel 128. The press unit 130 includes a lever 132 operably connected to a first engagement head 134. Pivotal action of the lever 132 is converted into linear motion of the first engagement head 134 along the actuation axis 108. A linkage 136 operably connects the lever 132 to a push rod 138 that carries the first engagement head 134 to convert the pivoting motion of the lever 132 into the linear motion of the first engagement head 134. The free end 140 of the first engagement head 134 may be dished, such as in a conical shape, to help stabilize a component engaged therewith during the assembly process. In the illustrated embodiment, the first engagement head 134 is threadedly attached to the push rod 138 to allow for axial adjustment of the first engagement head 134 along the actuation axis 108 for fine tuning operation of the pen press 100. However, the push rod 138 and first engagement head 134 could be formed as a single component. Further, other levers could be provided.

In this embodiment, the press unit 130 is attached to the base 120 in a fixed location along the actuation axis 108. However, in other embodiments, the press unit 130 could be axially adjustable along the actuation axis 108.

A carriage 150 is movably mounted to the base 120. The carriage 150 operably carries a second engagement head 152. The first and second engagement heads 134, 152 being substantially coaxial with and axially offset along the actuation axis 108. As such, actuation of lever 132 moves the first engagement head 134 toward or away from the second engagement head 152 along the actuation axis 108 depending on the direction of actuation of the lever 132.

The free end 154 of the second engagement head 152 may be dished, such as in a conical shape, to help stabilize a component engaged therewith during the assembly process.

In this embodiment, the second engagement head 152 is carried on a slide rod 156 that is slidably carried by the carriage 150. The slide rod 156 extends through a slot formed in the carriage 150. A biasing member 158, attached to the slide rod 156 at an end of the slide rod 156 opposite the second engagement head 152, biases the slide rod 156 and consequently second engagement head 152 axially towards the first engagement head 134 along the actuation axis 108. The second engagement head 152 may be formed as a single piece with the slide rod 156 or, preferably, may be threaded onto the slide rod 156 to, again, provide for additional fin adjustment of the pen press 100.

Figure 2:
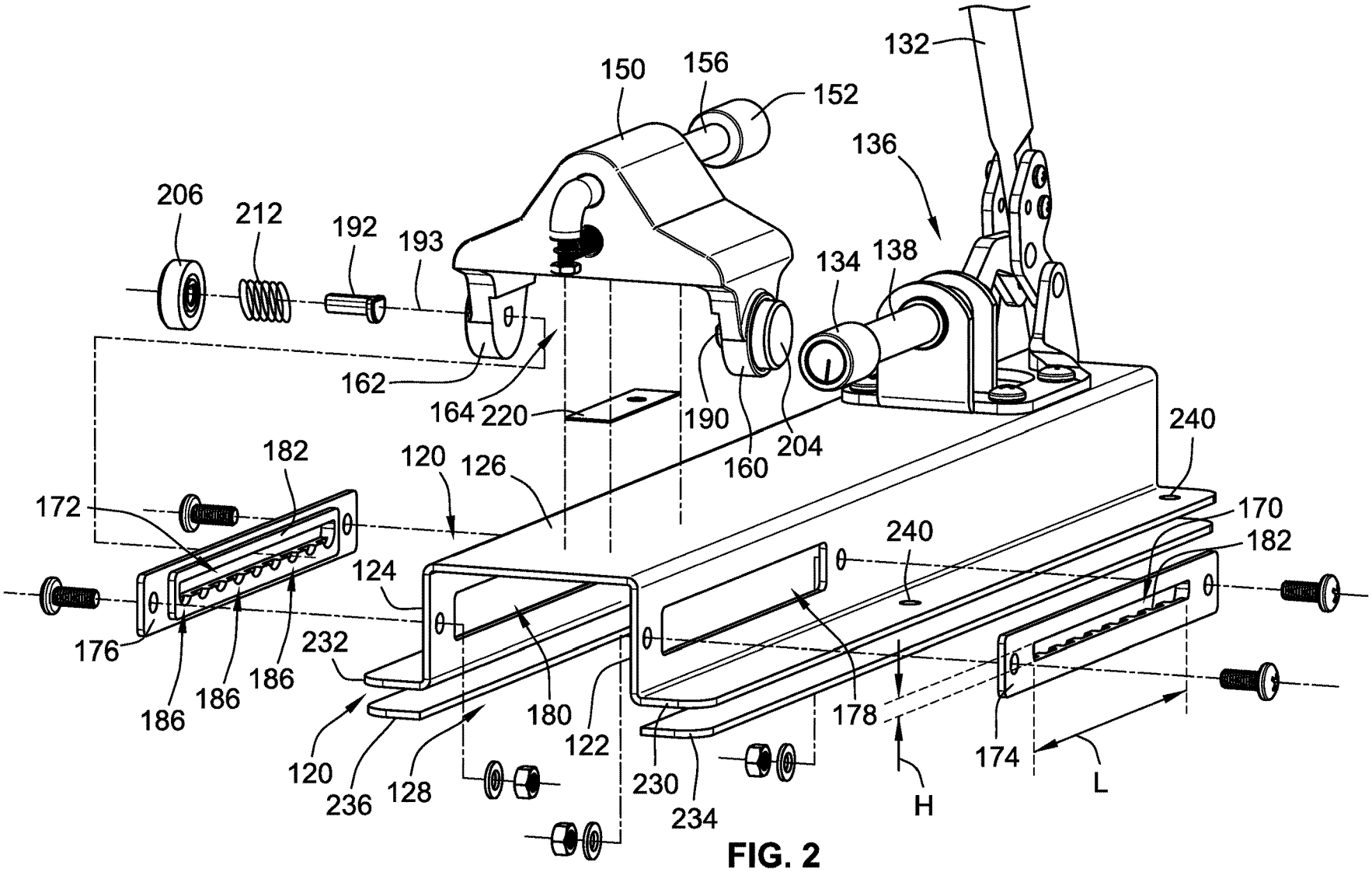
FIG. 2 is a partial exploded illustration of the pen assembling press of FIG. 1.

With additional reference to FIG. 2, the carriage 150 includes spaced apart first and second carriage legs 160, 162 defining a carriage channel 164 therebetween. When assembled, the carriage 150, and particularly first and second carriage legs 160, 162, straddles the base 120 with the base 120 positioned at least in part within the carriage channel 164 with the first and second legs 122, 124 and intermediate section 126 positioned, at least in part, between the first and second carriage legs 160, 162.

A positioning arrangement is provided between the carriage 150 and the base 120 to selectively fix the position of the carriage 150 relative to the base 120 along the actuation axis 108. The positioning arrangement includes slots 170, 172 extending through the first and second legs 122, 124. This embodiment, the slots 170, 172 are formed by inserts 174, 176 that are attached to the first and second legs 122, 124 and are positioned adjacent openings 178, 180 formed in the legs 122, 124. In this embodiment, the inserts 174, 176 include alignment projections 182 sized to insert into and mate with openings 178, 180 to properly align the slots 170, 172 relative to base 120.

The slots 170, 172 and openings 178, 180 extend through the first and second legs 122, 124 in a direction that is perpendicular actuation axis 108. The slots 170, 172 and openings 178, 180 extend lengthwise parallel to the actuation axis. Further, the slots 170, 172 have a constant height section that has a height H that is constant along the entire length (e.g. parallel to the actuation axis 108) of the constant height section. In this embodiment, the constant height section of the slots 170, 172 extends lengthwise substantially the entire length L of the slots 170, 172.

The positioning arrangement includes a plurality of recesses 186 positioned adjacent the constant height sections of the slots 170, 172. It is noted that, in this embodiment, the recesses 186 are semicircular recesses that transition into slots 170, 172. However, the recesses 186 are positioned laterally inward from and vertically offset from the constant height sections such that the constant height sections do not have any notches or grooves formed therein. Again, the constant height sections have a constant height along their lengths parallel to the actuation axis 108. In this embodiment, recesses 186 are only vertically below the constant height sections. However, recesses could be provided above or both above and below the constant height sections. Further, the recesses 186 need not merge into slots 170, 172 but could be entirely vertically offset from slots 170, 172.

It should be noted that the constant height sections are such that the pins 190, 192 and particularly the shafts 194, 196 thereof cannot move vertically when positioned therein.

Figure 3:
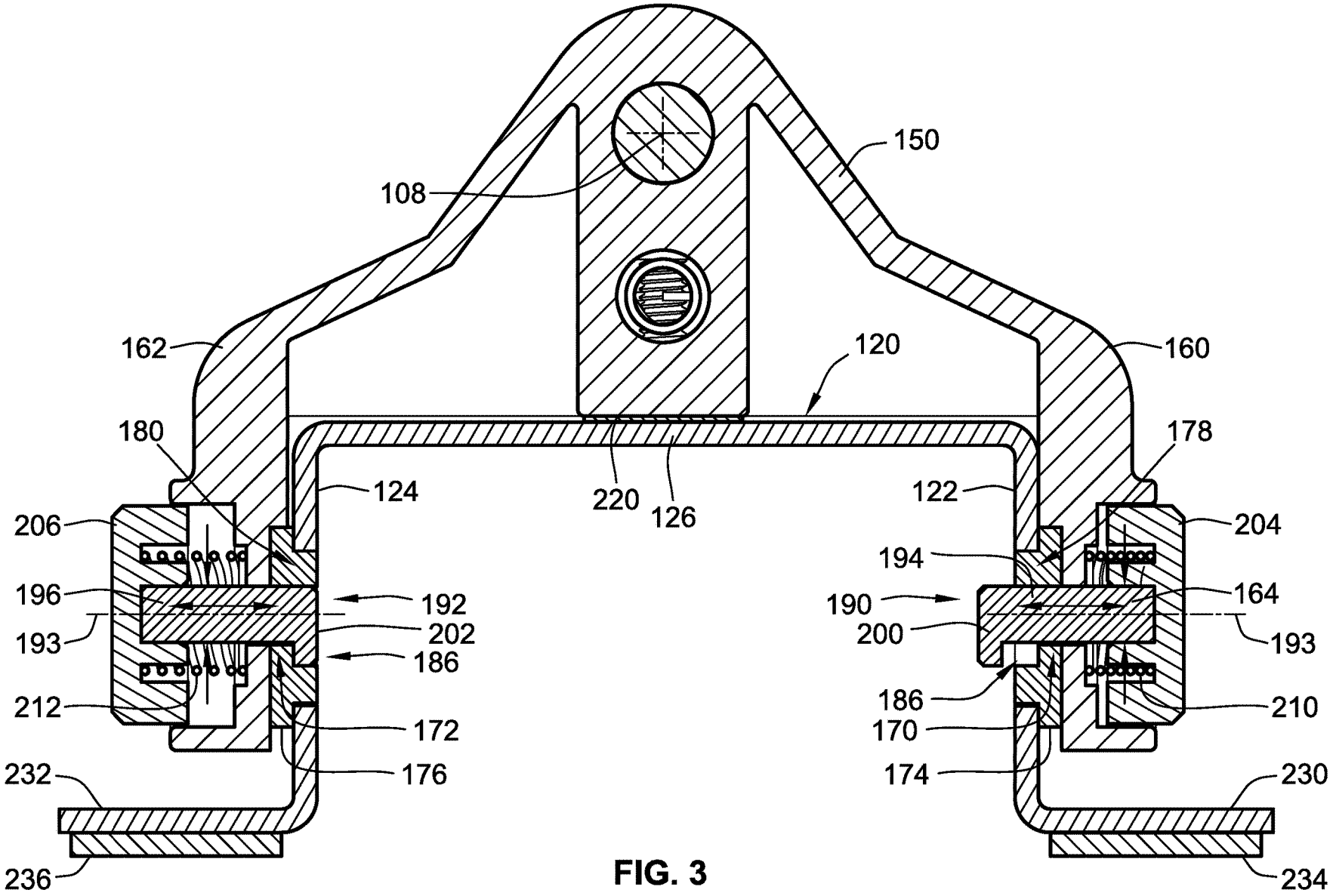
FIG. 3 is a cross-sectional illustration of the pen assembling press of FIG. 1.

With additional reference to the cross-sectional illustration of FIG. 3, the positioning arrangement further includes a pair of pins 190, 192 that selectively cooperate with recesses 186 to fix the axial location of the carriage 150 along the actuation axis 108. The pins 190, 192 are operably carried by the carriage 150. In this embodiment, the pins 190, 192 extend laterally through openings formed in the first and second carriage legs 160, 162. The pins 190, 192 are movable, e.g. slidable and illustrated by double headed arrows, relative to the carriage 150 along pin axes 193 that are perpendicular to the actuation axis 108 and first and second legs 122, 124 to operably engage and disengage recesses 186.

The pins 190, 192 include shafts 194, 196 are sized and configured to slide both laterally inward and outward, e.g. perpendicular to actuation axis 108 as well as lengthwise within slots 170, 172. The thickness T of the shafts 194, 196 is substantially equal to the height H (see FIG. 2) of the slots 170, 172 to allow such motion as well as to prevent substantial vertical play between the pints 190, 192 and the slots 170, 172/inserts 174, 176.

The pins 190, 192 also include heads 200, 202 sized and configured to be received in recesses 186. When the heads 200, 202 engage recesses 186, the pins 190, 192 axially fix the position of the carriage 150 relative to the base 120 along the actuation axis 108. The heads 200, 202 are selectively engaged and disengaged from recesses 186 by actuating the pins 190, 192 along pin axes 193 in a direction perpendicular to the actuation axis 108. When the heads 200, 202 are disengaged from, e.g. removed, recesses 186, the carriage 150 is movable along the actuation axis 108 relative to base 120. When the heads 200, 202 are engaged with, e.g. inserted into, recesses 186, the carriage 150 is prevented from moving along the actuation axis 108 relative to base 120.

The pins 190, 192 include actuation buttons 204, 206 that are engageable by the user to easily actuate the pins 190, 192 axially inward, e.g. towards one another for selectively disengaging the pins 190, 192 from recesses 186. Biasing members in the form of coil springs 210, 212 act between the actuation buttons 204, 206 and first and second carriage legs 160, 162, to bias the pins 190, 192 laterally outward, e.g. away from one another, to bias the pins 190, 192 toward a locked/engaged state wherein the pins 190, 192 engage recesses 186. The user must overcome this force to allow for actuation of the carriage 150 along actuation axis 108.

FIG. 3 illustrates pin 190 in a released or disengaged state where head 200 is free from recess 186 of insert 174. Pin 192 is illustrated in an engaged state where head 202 is received in or engaged with recess 186 of insert 176. Both pins 190, 192 would need to be in the disengaged state to allow carriage 150 to move along actuation axis 108.

The use of inserts 174, 176 makes it easier to manufacture the recesses 186 while providing the constant height sections. For instance, the inserts 174, 176 could be formed from cast or molded material such as cast metal or molded plastic while the base 120 can be formed from simple stamped or bent sheet metal. However, the recesses 186 and slots 170, 172 could be formed into the material used to form the rest of legs 122, 124 and intermediate section 126.

With reference to FIGS. 2 and 3, in some embodiments, a piece strip of low friction material 220 is positioned between the carriage 150 and the base 120. In the illustrated embodiment, the low friction material 220 is attached to an underside of the carriage 150 and is positioned adjacent the intermediate section 126 of base 120. The low friction material 220 allows for a tight fit between the carriage 140 and base 120 to prevent rocking of the carriage 150 relative to the base 120 during use, e.g. rocking about an axis that is parallel to pin axes 193. In other embodiments, the low friction material 220 could be attached to the outer surface of the intermediate section 126. In one embodiment, the low friction material is acetal polyoxymethylene resin.

With reference to FIGS. 2 and 3, in a preferred embodiment, when the pen press 100 is assembled, the intermediate section 126 is entirely free of any exposed openings extending through the intermediate section 126 into the base channel 128. This prevents any components of pens or other objects being formed using the pen press 100 from falling into the base channel 128. This is particularly useful when the pen press 100 is attached to a workbench or other support.

The base 120 includes first and second feet 230, 232 that extend laterally from corresponding first and second legs 122, 124. In the illustrated embodiment, the feet 230, 232 extend laterally outward from the corresponding first or second leg 122 and laterally away from one another. The first and second legs 122, 124 extend vertically between the corresponding foot 230, 232 and the intermediate section 126. Preferably, one or more strips of non-slip material 234, 236 is attached to the bottom surfaces of feet 230, 232 to prevent slippage of the pen press 100 relative to any work surface of a workbench. However, the pen press 100 can be directly affixed to the work bench using holes 240 formed through feet 230, 232.

In use, the user will adjust the position of the carriage 150 and consequently second engagement head 152 by actuating pins 190, 192 by pressing actuation buttons 204, 206 to disengage the pins 190, 192 from recesses 186. The user can then adjust the position of carriage 150 along the actuation axis 108. Thereafter, the user will put the pen components 104, 106 between the first and second engagement heads 134, 152. The biasing effect of biasing member 158 acting on slide rod 156 allows a limited amount of pressure to be sustained to keep the two components 104, 106 axially aligned and compressed between the first and second engagement heads 134, 152. Then, the user will actuate the lever 132 to provide increased force and drive the first engagement head 134 towards the second engagement head 152 along the actuation axis 108. The second actuation head 152 may slide within carriage 150 until it contacts the carriage 150 at which time the two components will begin to be pressed together.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pen assembling press comprising:

a base having spaced apart first and second legs and an intermediate section extending between and maintaining the spacing between the first and second legs, the first and second legs and intermediate section forming a base channel therebetween;

a press unit including:

a push rod carrying a first engagement head;

a lever connected to the push rod, an actuation of the lever moving the push rod relative to the base along an actuation axis;

a carriage carrying a second engagement head, the second engagement head being coaxial with the first engagement head along the actuation axis such that the actuation of the lever moves the push rod and first engagement head toward or away from the second engagement head along the actuation axis, the carriage being movably mounted to the base, the carriage including spaced apart first and second carriage legs defining a carriage channel therebetween, the carriage straddling the base with the base positioned at least in part within the carriage channel with the first and second legs and intermediate section positioned, at least in part, between the first and second carriage legs;

a positioning arrangement between the carriage and the base to selectively fix the position of the carriage relative to the base along the actuation axis, the positioning arrangement including:

a slot extending through the first leg in a direction perpendicular to the actuation axis, the slot extending lengthwise parallel to the actuation axis, the slot having a constant height section having a height;

a plurality of recesses offset along the actuation axis adjacent the constant height section; and a pin having a shaft and an a head, the pin being carried by the carriage, the head being sized to be received in the recesses, the shaft having a thickness being substantially equal to the height of the constant height section of the slot, the pin being movable relative to the carriage within the slot along a pin axis that is perpendicular to the actuation axis to selectively engage and disengage the recesses, when the head is removed from the recesses, the carriage being movable along the actuation axis relative to the base, when the head is inserted into one of the recesses, the carriage being fixed along the actuation axis relative to the base.

2. The pen assembling press of claim 1, wherein the pin is biased towards having the head engaged with one of the recesses.

3. The pen assembling press of claim 1, wherein the pin extends through the first carriage leg, the pin includes an actuation button engageable by a user, the actuation button extending laterally outward beyond the first carriage leg in a relaxed state along the pin axis.

4. The pen assembling press of claim 1, further comprising a low-friction material positioned between the carriage and the intermediate section providing reduced friction between the carriage and intermediate section.

5. The pen assembling press of claim 4, wherein the low-friction material is acetal polyoxymethylene resin.

6. The pen assembling press of claim 1, wherein a portion of the intermediate section between the press unit and the carriage is free of any exposed openings extending therethrough from a top side facing the carriage and press unit into the base channel.

7. The pen assembling press of claim 1, further comprising:

first and second feet, the first foot attached to the first leg, the first leg extending between the first foot and the intermediate section, the second foot attached to the second leg, the second leg extending between the second foot and the intermediate section;

a non-slip material attached to the first and second feet to inhibit slipping of the first and second feet when located on a working surface.

8. The pen assembling press of claim 1, wherein the second engagement head is slidably carried on the carriage along the actuation axis.

9. The pen assembling press of claim 1, further comprising a biasing member operably acting on the engagement head to bias the second engagement head towards the first engagement head along the actuation axis.

10. The pen assembling press of claim 1, wherein the plurality of recesses are immediately adjacent to and intersect with the slot but are positioned laterally offset from the constant height section along the pin axis such that the shaft of the pin cannot move into the recesses along an axis being perpendicular to the pin axis and perpendicular to the actuation axis.

11. The pen assembling press of claim 1, wherein the pin comprises a pair of pins that are oriented opposite one another such that the pins are pressed toward one another to allow the carriage to move and are released and biased away from one another to engage corresponding recesses to prevent the carriage from moving along the actuation axis.

12. A method of assembling a pen having a first component that is axially inserted into a second component, the method comprising:

providing a pen assembling press comprising:

a base having spaced apart first and second legs and an intermediate section extending between and maintaining the spacing between the first and second legs, the first and second legs and intermediate section forming a base channel therebetween;

a press unit including:

a push rod carrying a first engagement head;

a lever connected to the push rod, an actuation of the lever moving the push rod relative to the base along an actuation axis;

a carriage carrying a second engagement head, the second engagement head being coaxial with the first engagement head along the actuation axis such that the actuation of the lever moves the push rod and first engagement head toward or away from the second engagement head along the actuation axis, the carriage being movably mounted to the base, the carriage including spaced apart first and second carriage legs defining a carriage channel therebetween, the carriage straddling the base with the base positioned at least in part within the carriage channel with the first and second legs and intermediate section positioned, at least in part, between the first and second carriage legs;

a positioning arrangement between the carriage and the base to selectively fix the position of the carriage relative to the base along the actuation axis, the positioning arrangement including:

a slot extending through the first leg in a direction perpendicular to the actuation axis, the slot extending lengthwise parallel to the actuation axis, the slot having a constant height section having a height;

a plurality of recesses offset along the actuation axis adjacent the constant height section; and a pin having a shaft and an a head, the pin being carried by the carriage, the head being sized to be received in the recesses, the shaft having a thickness being substantially equal to the height of the constant height section of the slot, the pin being movable relative to the carriage within the slot along a pin axis that is perpendicular to the actuation axis to selectively engage and disengage the recesses, when the head is removed from the recesses, the carriage being movable along the actuation axis relative to the base, when the head is inserted into one of the recesses, the carriage being fixed along the actuation axis relative to the base;

actuating the pin of the pen assembling press along the pin axis to disengage the head from the plurality of recesses;

sliding the carriage along the actuation axis with the shaft of the pin sliding within the constant height section generally parallel to the actuation axis; and releasing the pin to engage the head with one of the plurality of recesses to fix the position of the carriage along the actuation axis.

13. The method of claim 12, further comprising:

positioning the first and second components between the first and second engagement heads; and actuating the lever to drive the first engagement head toward the second engagement head to press the first component into the second component.

14. The method of claim 13, further comprising biasing the second engagement head along the actuation axis after positioning the first and second components between the first and second engagement heads.

15. The method of claim 12, wherein the step of actuating the pin includes overcoming a biasing force acting on the pin that biases the pin towards having the head engaged with one of the recesses.

16. The method of claim 12, wherein the pin extends through the first carriage leg, the pin includes an actuation button engageable by a user, the step of actuating the pin includes pressing the actuation button laterally inward.

17. The method of claim 12, wherein a portion of the intermediate section between the press unit and the carriage is free of any exposed openings extending therethrough from a top side facing the carriage and press unit into the base channel.

* * * * *